US005469800A

United States Patent [19]

Brotz

[11] Patent Number: 5,469,800

[45] Date of Patent: Nov. 28, 1995

[54] NAUTICAL FUEL OVERFLOW PROTECTION DEVICE AND METHOD

[76] Inventor: Gregory R. Brotz, P.O. Box 1322, Sheboygan, Wis. 53081

[21] Appl. No.: 292,850

[22] Filed: Aug. 19, 1994

[51] Int. Cl.[6] ..... B63B 25/08

[52] U.S. Cl. ..... 114/74 R; 114/343

[58] Field of Search ..... 114/343, 74 R; 141/307

[56] References Cited

U.S. PATENT DOCUMENTS 4,802,514 2/1989 Morse ..... 114/343

5,070,806 12/1991 Coster ..... 114/343

5,230,372 7/1993 Westphal ..... 114/343

*Primary Examiner*—Jesus D. Sotelo

*Attorney, Agent, or Firm*—William Nitkin

[57] ABSTRACT

A device and method for use when filling the internal fuel tank of a boat having an air outlet vent in fluid communication with the fuel tank with the air outlet vent exiting from a side of the boat's hull with the structure of the device disposed in proximity to the air outlet vent for the collection and proper disposal of any overflow fuel exiting the air outlet vent to prevent its discharge into the water surrounding the boat.

18 Claims, 4 Drawing Sheets

NAUTICAL FUEL OVERFLOW PROTECTION DEVICE AND METHOD

BACKGROUND OF THE INVENTION

1. Field of the Invention

The device and method of this invention resides in the area of boat fuel tank overflow prevention devices and more particularly relates to a device which is attached to a boat's air outlet vent to catch any overflow of fuel passing therethrough to prevent spillage of fuel into the surrounding water and its method of use.

2. Description of the Prior Art

Large boats with internal fuel tanks frequently have fuel inlet pipes disposed on their decks and such fuel tanks, being located below deck have air outlet pipes which allow air to vent from the fuel tank as it is being filled. If the fuel tank has filled with fuel, excess fuel will pass into the air outlet pipe and out an exterior air outlet vent which vent extends beyond the side of the hull, causing small amounts of gasoline or fuel to spill into the surrounding body of water. This spillage causes undesirable pollution and can violate certain government regulations concerning the release of fuel, such as gasoline, into bodies of water. Many boat owners, when filling their boats with fuel, will open the fuel cap and fill the fuel tank until they see the fuel coming out of the air outlet vent and then they know that the boat's fuel tank is full. Often several ounces of fuel can pass through such air outlet vent and fall into the water before the person adding fuel to the fuel tank will notice and stop adding fuel to the fuel tank. Such practice, though, is improper. Even though only a small amount of fuel may fall into the surrounding body of water from each boat, such spillages nevertheless cumulatively can cause a great deal of pollution of bodies of water that can be harmful to the environment and wildlife.

SUMMARY OF THE INVENTION

It is an object of this invention to provide a convenient and inexpensive device in the form of a container in one embodiment which fits over the air outlet vent of the fuel tank of a boat to catch any fuel coming out the air outlet vent to prevent it from falling into the surrounding body of water below. In order to catch such fuel, it is a further object of this invention to provide absorbent members to absorb and trap the fuel for environmentally safe and easy disposal of the fuel-holding device.

In one embodiment of this invention the device can consist of a plastic-lined or coated cardboard or plastic container with an aperture disposed on the rear side thereof and a sponge or other absorbent member optionally placed in the bottom thereof with self-adhesive stick-on tabs also disposed on the rear side of the container. In use, the aperture is placed over the air outlet vent, and the self-adhesive tabs are adhered to the boat hull, causing any fuel that passes through the air outlet vent which is then disposed through the aperture and within the container to fall within the inside of the container, drop onto the sponge member below and be absorbed and trapped therein. When the overflow fuel flow stops, the container can then be removed from the hull of the boat by releasing the self-adhesive tabs which will, by outward pulling of the container, come free from the boat hull. The entire container with sponge therein containing the gasoline or fuel can then be properly disposed of in a trash receptacle that is properly labeled for disposal of fuel or oil-contaminated items which designated receptacles are usually located at boat marinas.

The device of this invention can also take other forms to accomplish the goals of this invention. A sponge member with self-adhesive means disposed on a rear side can be placed under the air outlet vent so that the fuel passes directly into the sponge member and is absorbed therein. The sponge member in another embodiment can have a notch on its upper rear top to allow the sponge member to better fit around the air outlet vent. In an alternate embodiment such sponge member can have a hollowed out portion on its rear side with such hollow portion being inserted over the air outlet vent to allow the fuel to pass into the sponge member and be absorbed therein. All embodiments of the device of this invention have self-adhesive means disposed on their rear sides to retain the device to the boat hull during use of this invention. A handle member can be positioned on top of such a sponge member to make it easier to grasp the device when pulling the sponge member and its adhesive tabs off the boat hull after use and in the transporting of the device so that the fuel-soaked sponge member does not come in direct contact with the individual disposing of the sponge member. The sponge member can have a fuel-impervious coating on its sides for ease and convenience in handling. Such coating will help prevent fuel from passing therethrough in any way but should not block the passage therethrough of air. It should be noted that the sponge member is designed to have sufficient fluid-absorbing capability to absorb all of the fuel that might inadvertently pass out the air outlet vent. It should be further noted that all versions of the device of this invention allow air to pass through them so as not to block any air or fuel escaping through the air outlet vent.

BRIEF DESCRIPTION OF THE DRAWINGS

FIG. 6 illustrates a cross-sectional side view of the sponge member of

FIG. 5 installed on an air outlet vent extending through the hull of a boat and is affixed thereto by self-adhesive means.

DESCRIPTION OF THE PREFERRED EMBODIMENT(S)

Figure 1:
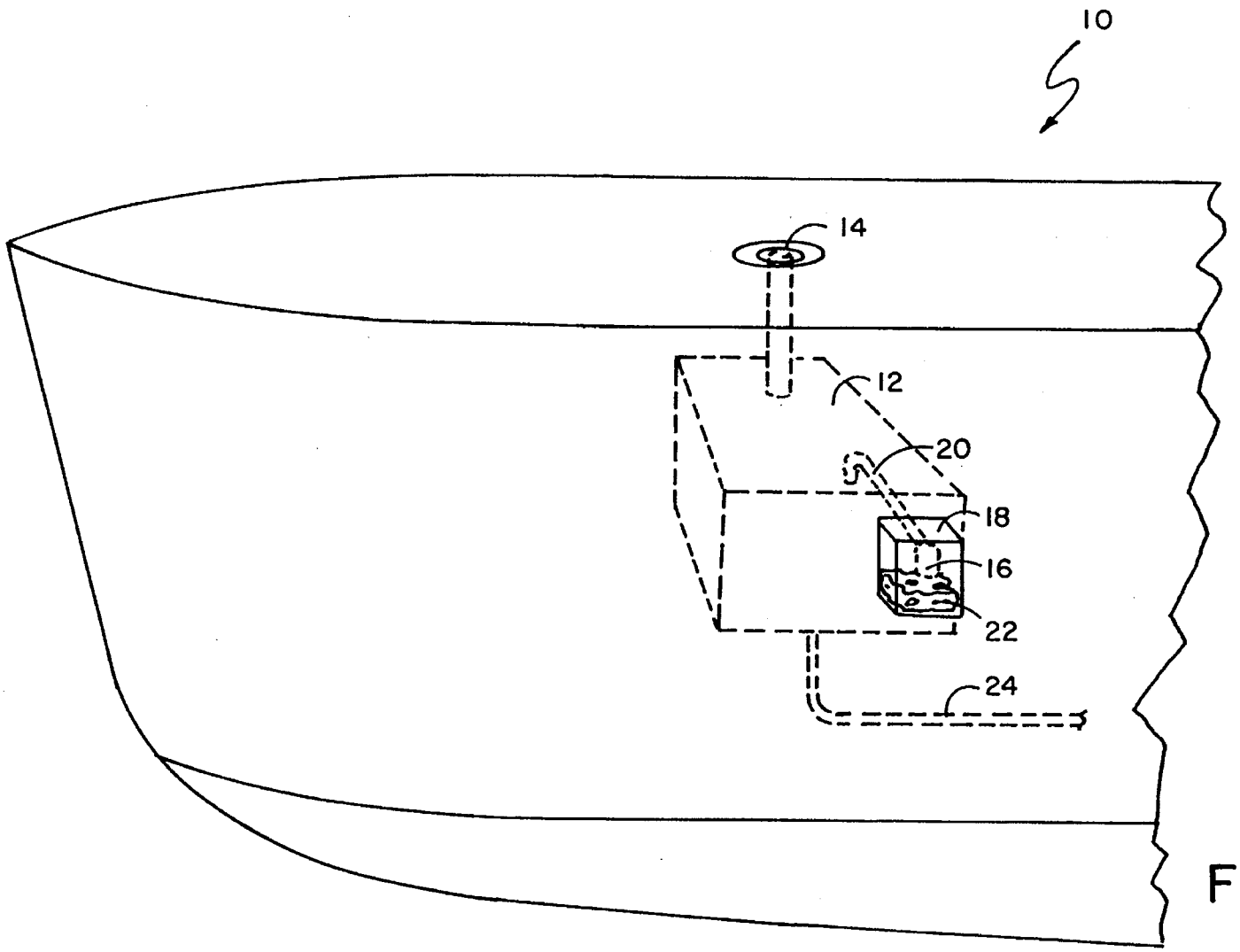
FIG. 1 illustrates a sectional, see-through view of a portion of a boat having an internal fuel tank showing one embodiment of the device of this invention mounted on the hull of the boat.

FIG. 1 illustrates a boat 10 seen in simplified form having a fuel tank 12 with a fuel inlet 14 located on the deck of the boat. Fuel is added through fuel inlet 14 and passes down into fuel tank 12. As the fuel tank fills with fuel, air in the fuel tank escapes through air outlet pipe 20 and exits through air outlet vent 16 which extends beyond the side of the hull of the boat. Seen installed on air outlet vent 16 is one embodiment of the device 18 of this invention having a sponge 22 or equivalent absorption means disposed in the bottom thereof. In normal use a fuel line 24 would extend from fuel tank 12 to the motor of the boat not shown in this Figure.

Figure 2:
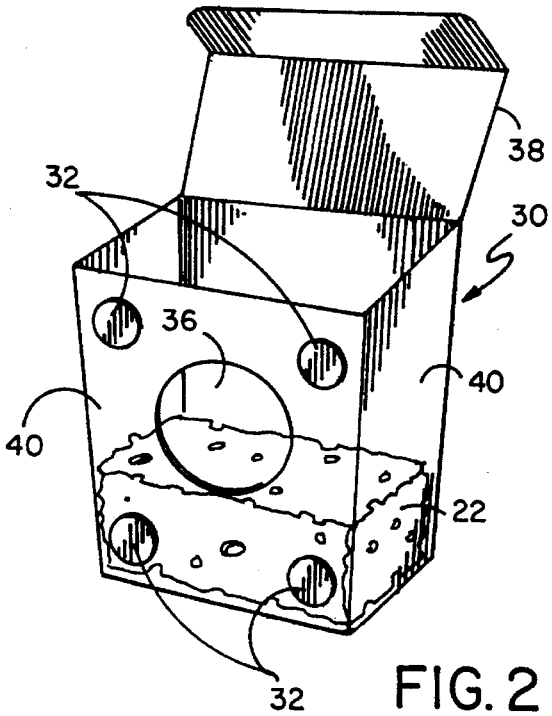
FIG. 2 illustrates a perspective rear view of one embodiment of the device of this invention.
Figure 3:
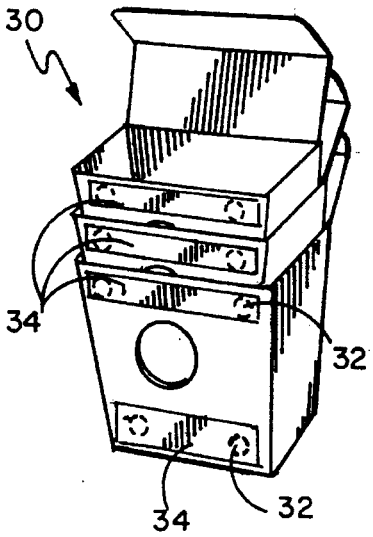
FIG. 3 illustrates a perspective view of a plurality of devices of this invention stacked for storage.
Figure 4:
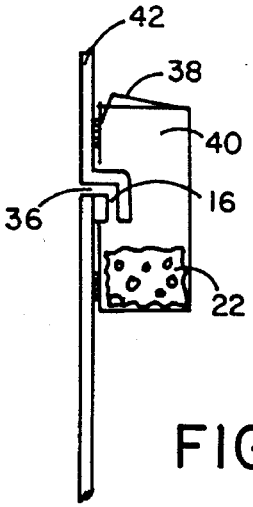
FIG. 4 illustrates a cross-sectional side view through a boat hull showing the air outlet vent extending beyond the hull through which any overflow fuel passes into the device of this invention.

FIG. 2 illustrates a rear perspective view of one embodiment of the device of this invention, being container 30 which can be made of cardboard with a plastic coating on the interior thereof which is impervious to gasoline or other fuels or the container can be made of other material impervious to gasoline such as plastic. All sides of container 30 can be tapered downward so that, as seen in FIG. 3, a plurality of containers 30 can be stacked one within the other for storage. Seen in FIG. 2 is sponge 22 disposed in the bottom of container 30 with an aperture 36 defined on the rear side of container 30 and a lid 38, which when stacked, can be open to allow the containers, as seen in FIG. 3, to be nested one within the other and in use, as seen in FIG. 4, to be closed. The sponge, if desired, can be in a compressed state which will expand when it absorbs fuel. In use of the device, as seen in FIG. 4, air outlet vent 16 is positioned within aperture 36 such that should any overflow of fuel occur during filling of the fuel tank, it will come out air outlet vent 16 and fall onto sponge 22 in the bottom of the container. The container can be affixed to the boat hull by a plurality of self-adhesive tabs 32. After the fuel tank has been filled, the device can be released from the hull by pulling outwardly with sufficient force on the container to pull it away from the hull. When the container is not in use, tabs 32 can be covered with a silicon-coated paper 34, as seen in FIG. 3, and when ready for use, these paper members can be peeled off, exposing the self-adhesive tabs. Other types of fastening means can be used to adhere the device to the boat hull. For example, hook-and-loop fasteners can be used with the hook portion adhered to the hull and the loop portion positioned on the rear of the absorbent member or container. Other types of hooks can be used on the hull to hook through the aperture or recess in the absorbent member.

Figure 6:
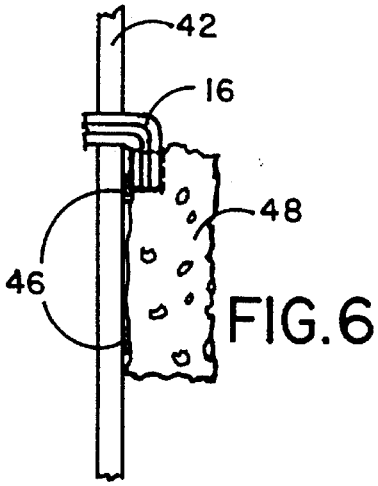
Figure 5:
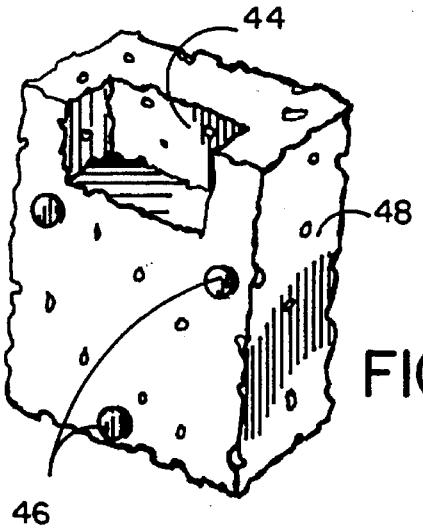
FIG. 5 illustrates a perspective rear view of an alternate embodiment of the device of this invention, being a sponge member having a notch formed on the top rear thereof for receipt of the air outlet vent.
Figure 8:
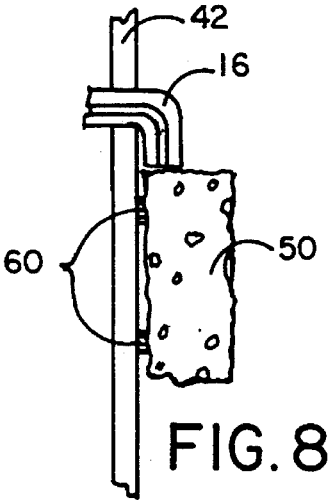
FIG. 8 illustrates a cross-sectional side view of the sponge member of FIG. 7 attached by hook-and-loop fastening means to the boat hull under the air outlet vent of the fuel tank.
Figure 7:
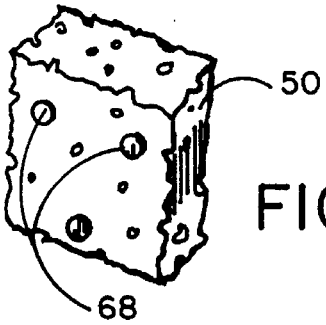
FIG. 7 illustrates a perspective rear view of an alternate embodiment of a sponge member to be placed directly under the air outlet vent to catch any overflow fuel, said sponge member having one portion of hook-and-loop fastening means adhered to its rear side.

An alternate embodiment of the device of this invention, being notched absorbent member 48, is seen in FIG. 5 which can be made of a sponge or other absorbent material and having self-adhesive tabs 46 disposed on the rear thereof. Sometimes the overflow fuel can come out of the air outlet vent at a fast rate which rate may be faster than the absorbent member's ability to absorb the fuel and the fuel could splash off the absorbent member. The notched recess in which the air outlet vent is positioned in absorbent member 48 helps to confine the fuel until it can be absorbed in the absorbent member. Notch 44 can be rectangular in shape or of other shapes and is defined in the rear top thereof of the absorbent member such that, as seen in FIG. 6, when absorbent member 48 is placed over air outlet vent 16 protruding from hull 42, any gasoline dripping therefrom falls directly into the mass of sponge-like material. This absorbent member can be modified, as seen in FIG. 7, by eliminating the notch and placing the top of body 50 directly under air outlet vent 16, as seen in FIG. 8, to absorb and accumulate the fuel within body 50. The fasteners in any of the embodiments can be hook-and-loop type fasteners 66, such as Velcro brand fasteners, wherein strips or patches of one portion of such hook-and-loop members can be adhered to the boat hull and strips or patches of mating portions 68 can be adhered to the rear side of the device 50 as seen in FIGS. 7 and 8. The portions of the hook-and-loop fasteners that are adhered to the boat hull can be left there for multiple uses.

Figure 10:
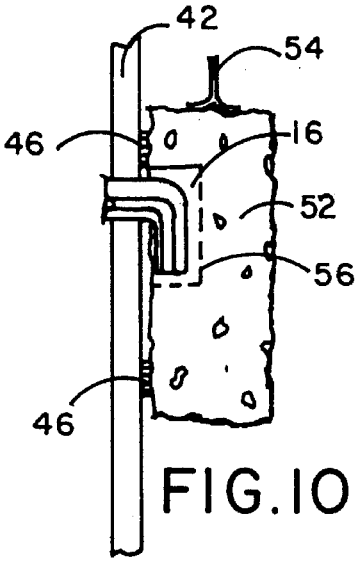
FIG. 10 illustrates a cross-sectional side view of the embodiment of FIG. 9 installed over the air outlet vent and affixed to the boat hull.
Figure 9:
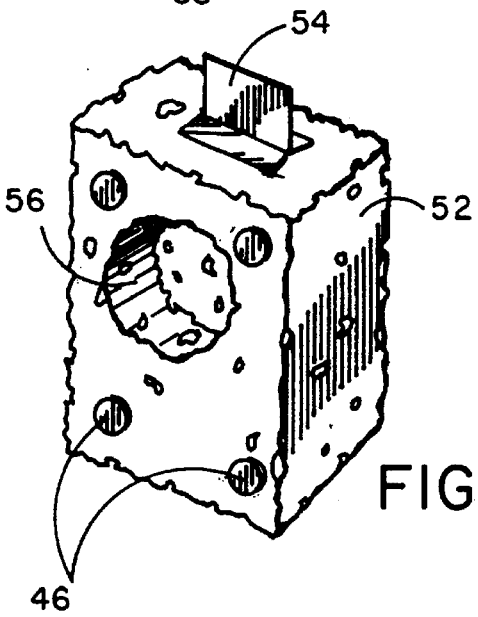
FIG. 9 illustrates a perspective rear view of a further embodiment of the sponge member of this invention having a hollow portion formed in the rear thereof and having a handle member disposed on the top thereof.

A yet further embodiment of this invention is shown in FIG. 9 wherein absorbent member 52 has a plurality of self-adhesive tabs 46 disposed on the rear thereof. A hollow portion 56 is defined in the rear thereof. This hollow portion is placed over air outlet vent 16, as seen in FIG. 10, such that air outlet vent 16 passes any overflowing fuel into absorbent member 52. Also seen in this view is handle 54 which can be adhered by stong adhesive means to the top of absorbent member 52. This type of handle can also be attached to the embodiments of the invention as seen in FIGS. 5 and 7. In use, after any fuel has passed into the absorbent member during filling of the fuel tank, one can grasp handle 54 to pull the fuel-soaked absorbent member away from the hull, thereby releasing the adhesive of tabs 46 from the hull to allow the user to carry the fuel-containing device away for proper disposal.

Figure 11:
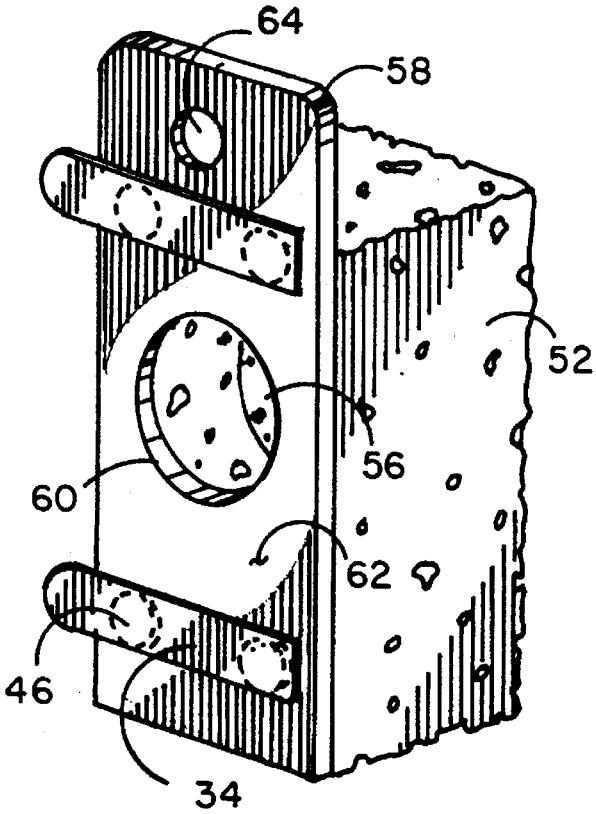
FIG. 11 illustrates a perspective rear view of an alternate embodiment of the sponge member of FIG. 9 having a planar member incorporating handle means affixed to its rear side and having self-adhesive means disposed on the rear of the planar member.

FIG. 11 illustrates a perspective rear view of an alternate embodiment of absorbent member 52 which has a planar member 62, which can be made of cardboard or equivalent stiff material such as plastic, affixed to the rear surface of absorbent member 52 by adhesive means or equivalent means of affixation. An aperture 60 is defined in planar member 62 corresponding in size and position to hollow portion 56 in absorbent member 52. On the rear surface of planar member 62 is disposed a plurality of self-adhesive tabs 46. Covering these self-adhesive tabs 46 when the device is not in use is silicon-coated paper 34 which paper is removed when the device is to be used. Top 58 of planar member 62 extends beyond the top of absorbent member 52 and can serve as a handle. Top aperture 64 can be defined in the top 58 of planar member 62 for ease in grasping the device and pulling it away from the hull of the boat and for carrying it for disposal. Top aperture 64 can also serve as means to hang and store the device prior to use.

Figure 12:
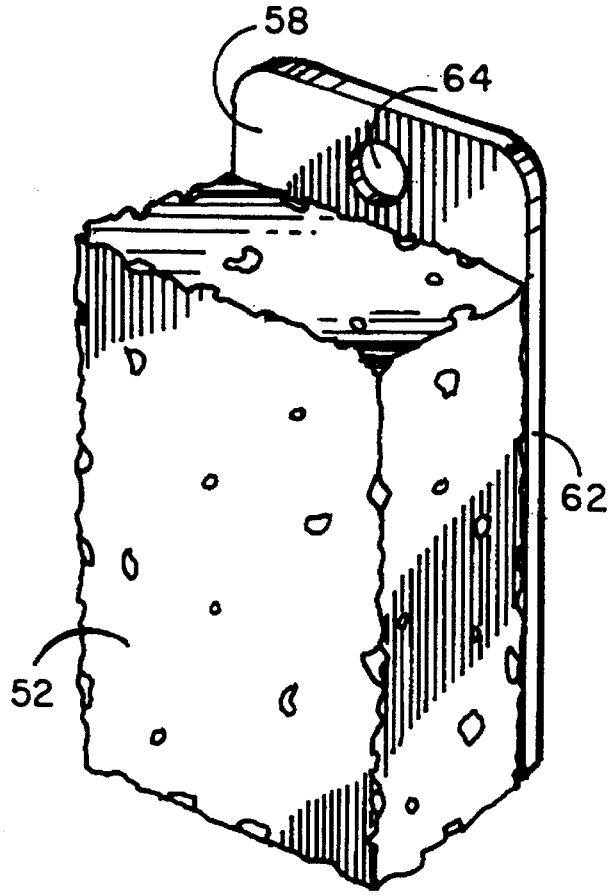
FIG. 12 illustrates a perspective front view of the embodiment of FIG. 11.

FIG. 12 illustrates a perspective front view of the embodiment of FIG. 11 showing absorbent member 52, top aperture 64 and top 58 of planar member 62.

Although the present invention has been described with reference to particular embodiments, it will be apparent to those skilled in the art that variations and modifications can be substituted therefor without departing from the principles and spirit of the invention.

I claim:

1. A device for use when filling the internal fuel tank of a boat having an air outlet vent in fluid communication with said fuel tank, said air outlet vent exiting from a side of said boat's hull, said device comprising:

means disposed in proximity to said air outlet vent to collect any fuel exiting said air outlet vent wherein said means include:

a container having a front side having a surface, a rear side, a left side, a right side, a top, and a bottom, said container having an aperture defined in said rear side;

means to adhere said device to said hull with said air outlet vent as through said aperture to be disposed within said container for the collection of said fuel exiting said air outlet vent; and means disposed within said container to absorb said fuel exiting said air outlet vent.

2. The device of claim 1 wherein said absorption means is a sponge-like member located in said bottom of said container.

3. The device of claim 1 wherein said means to adhere said device to said hull is at least one self-adhesive tab disposed on said rear side of said container.

4. The device of claim 3 wherein said sides of said container are tapered toward said bottom of said container for the stacking of said devices when not in use.

5. The device of claim 4 wherein said top of said container is a lid which is disposed in an open mode when said device in not in use and is disposed in a closed mode when said device is in use.

6. The device of claim 5 wherein said self-adhesive tabs have removable coverings when said device is not in use, which coverings are removed when said device is in use.

7. The device of claim 1 wherein said means to adhere said device to said hull are hook-and-loop fastening means with one portion thereof adhered to said rear side of said container and its mating portion adhered to said boat hull.

8. A device for use when filling the internal fuel tank of a boat having an air outlet vent in fluid communication with said fuel tank, said air outlet vent exiting from a side of said boat's hull, said device comprising:

means disposed in proximity to said air outlet vent to collect any fuel exiting said air outlet vent, said means including:

an absorbent member having a front side, a rear side, a top and a bottom; and means to adhere said device to said hull of said boat.

9. The device of claim 8 wherein said means to adhere said device is at least one self-adhesive tab adhered to said rear of said absorbent member; and wherein said absorbent member is positioned beneath said air outlet vent to absorb fuel exiting from said air outlet vent.

10. The device of claim 9 wherein said rear side of said absorbent member has a notch defined at said top of said absorbent member, said notch of a size to receive and fit around said air outlet vent.

11. The device of claim 8 wherein said means to adhere said device to said hull are hook-and-loop fastening means with one portion thereof adhered to said rear side of said absorbent member and its mating portion adhered to said boat hull; and wherein said absorbent member is positioned beneath said air outlet vent to absorb fuel exiting from said air outlet vent.

12. The device of claim 8 wherein said absorbent member has a hollow portion defined in said rear side thereof, said hollow portion of a size to receive said air outlet vent therein.

13. The device of claim 12 further including a planar member having a top, a rear surface and a front surface, said front surface of said planar member adhered to said rear side of said absorbent member, said planar member having an aperture defined therein corresponding in size and position to said size and position of said hollow portion, said top of said planar member extending beyond said absorbent member to form a grasping member.

14. The device of claim 13 wherein said means to adhere said device to said hull is at least one self-adhesive tab disposed on said rear surface of said planar member.

15. The device of claim 13 wherein said means to adhere said device to said hull are hook-and-loop fastening means with one portion thereof adhered to said rear surface of said planar member and its mating portion adhered to said boat hull.

16. The device of claim 8 further including a handle member disposed on said top of said absorbent member.

17. The method of collecting overflow fuel exiting the air outlet vent of an internal fuel tank of a boat when said fuel tank is being overfilled, said air outlet vent exiting from a side of said boat's hull, comprising the steps of:

providing a container having a front side, a rear side, a top, a bottom, an aperture defined in said rear side, and an absorbent member positioned in said bottom of said container;

providing at least one mounting means to adhere said container to said hull;

passing said air outlet vent through said aperture to be disposed within said container;

adhering said container to said hull of said boat by utilizing said mounting means;

filling said fuel tank with fuel until overflow fuel exits said air outlet vent;

collecting said overflow fuel in said absorbent member in said container;

removing said container from said hull; and properly disposing of said container.

18. The method of collecting overflow fuel exiting the air outlet vent of an internal fuel tank of a boat when said fuel tank is being overfilled, said air outlet vent exiting from a side of said boat's hull, comprising the steps of:

providing an absorbent member having a front side, a rear side, a top, and a bottom;

providing at least one mounting means to adhere said absorbent member to said hull;

positioning said absorbent member in a position on said hull where any overflow fuel exiting said air outlet vent will be absorbed in said absorbent member;

adhering said absorbent member to said hull of said boat by utilizing said mounting means;

filling said fuel tank with fuel until overflow fuel exits said air outlet vent;

collecting said overflow fuel in said absorbent member;

removing said absorbent member from said hull; and properly disposing of said absorbent member.

* * * * *

UNITED STATES PATENT AND TRADEMARK OFFICE

CERTIFICATE OF CORRECTION

PATENT NO. : 5,469,800

DATED : November 28, 1995

INVENTOR(S) : Gregory R. Brotz

It is certified that error appears in the above-identified patent and that said Letters Patent is hereby corrected as shown below:

In Column 5, line 13, please delete "as" and substitute --passing--.

Signed and Sealed this

Fifth Day of March, 1996

Bruce Lehman

*Attest:*

BRUCE LEHMAN

*Attesting Officer*

*Commissioner of Patents and Trademarks*